US007183524B2

(12) United States Patent
Naylor et al.

(10) Patent No.: US 7,183,524 B2
(45) Date of Patent: Feb. 27, 2007

(54) MODULAR HEATED COVER

(76) Inventors: David Naylor, 1141 E. Old Dairy Rd., Sandy, UT (US) 84094; Dan Alex Hillesheim, 8793 Ida La., Sandy, UT (US) 84093

( * ) Notice: Subject to any disclaimer, the term of this patent is extended or adjusted under 35 U.S.C. 154(b) by 0 days.

(21) Appl. No.: 11/344,830

(22) Filed: Feb. 1, 2006

(65) Prior Publication Data

US 2006/0191903 A1 Aug. 31, 2006

Related U.S. Application Data

(63) Continuation-in-part of application No. 11/218,156, filed on Sep. 1, 2005.

(60) Provisional application No. 60/688,146, filed on Jun. 6, 2005, provisional application No. 60/656,060, filed on Feb. 23, 2005, provisional application No. 60/654,702, filed on Feb. 17, 2005.

(51) Int. Cl.
*H05B 3/34* (2006.01)

(52) U.S. Cl. ..... 219/528; 219/213; 219/539

(58) Field of Classification Search ..... 219/528, 219/537, 539, 213
See application file for complete search history.

(56) References Cited

U.S. PATENT DOCUMENTS

| | | | | |
|---|---|---|---|---|
| 2,745,942 A * | 5/1956 | Cohen | 219/528 |
| 3,417,229 A | 12/1968 | Shomphe et al. | 219/528 |
| 3,510,547 A | 5/1970 | Eisler | 264/33 |
| 3,649,725 A | 3/1972 | Olson | 264/40 |
| 3,659,077 A | 4/1972 | Olson | 219/213 |
| 3,729,614 A | 4/1973 | Martinet | 219/345 |
| 3,812,320 A | 5/1974 | Borgren | 219/213 |
| 3,868,825 A | 3/1975 | Boyce | 61/36 |
| 3,897,928 A | 8/1975 | Eisler | 249/78 |
| 4,060,710 A | 11/1977 | Reuter et al. | 219/548 |
| 4,091,266 A | 5/1978 | Ito et al. | 219/504 |
| 4,238,105 A | 12/1980 | West | 249/78 |
| 4,316,080 A | 2/1982 | Wroblewski | 219/505 |
| 4,423,694 A | 1/1984 | Senneville | 122/405 |
| 4,457,491 A | 7/1984 | Dudman | 251/317 |

(Continued)

FOREIGN PATENT DOCUMENTS

JP 04350257 12/1992

(Continued)

OTHER PUBLICATIONS

"Thawzall Heater" http://www.themachinecompany.com/fag.htm.

(Continued)

*Primary Examiner*—Robin Evans
*Assistant Examiner*—Vinod Patel
(74) *Attorney, Agent, or Firm*—Kunzler & McKenzie

(57) ABSTRACT

The modular heated cover is disclosed with a first pliable outer layer and a second pliable outer layer, wherein the outer layers provide durable protection in an outdoor environment, an electrical heating element between the first and the second outer layers, the electrical heating element configured to convert electrical energy to heat energy, and a thermal insulation layer positioned above the active electrical heating element. Beneficially, such a device provides radiant heat, weather isolation, temperature insulation, and solar heat absorption efficiently and cost effectively. The modular heated cover quickly and efficiently removes ice, snow, and frost from surfaces, and penetrates soil and other material to thaw the material to a suitable depth. A plurality of modular heated covers can be connected on a single 120 Volt circuit or on a single 240 Volt circuit protected by a 20 Amp breaker.

15 Claims, 10 Drawing Sheets

U.S. PATENT DOCUMENTS

| | | | | |
|---|---|---|---|---|
| 4,607,154 | A | 8/1986 | Mills | 219/505 |
| 4,899,031 | A | 2/1990 | Dyer | 219/213 |
| 4,967,057 | A | 10/1990 | Bayless et al. | 219/213 |
| 5,371,340 | A | 12/1994 | Stanfield | 219/217 |
| 5,590,478 | A | 1/1997 | Furness | 34/437 |
| 5,614,292 | A | 3/1997 | Saylor | 428/209 |
| 5,780,367 | A | 7/1998 | Handwerker | 442/235 |
| 5,824,996 | A | 10/1998 | Kochman et al. | 219/529 |
| 6,184,496 | B1 | 2/2001 | Pearce | 219/213 |
| 6,189,487 | B1 | 2/2001 | Owen et al. | 119/28.5 |
| 6,211,493 | B1 | 4/2001 | Bouman | 219/213 |
| 6,279,856 | B1 | 8/2001 | Rutherford et al. | 244/134 |
| 6,294,768 | B1 | 9/2001 | Liebich | 219/528 |
| 6,330,986 | B1 | 12/2001 | Rutherford et al. | 244/134 |
| 6,392,209 | B1 | 5/2002 | Oppitz | 219/549 |
| 6,426,488 | B2 | 7/2002 | Schielke | 219/505 |
| 6,483,087 | B2 | 11/2002 | Gardner et al. | 219/545 |
| 6,667,100 | B2 | 12/2003 | Rutherford et al. | 428/408 |
| 6,673,289 | B2 | 1/2004 | Reynolds, III et al. | 264/115 |
| 6,841,250 | B2 | 1/2005 | Tzeng | 428/408 |
| 6,855,915 | B2 | 2/2005 | Gehring | 219/213 |
| 6,886,233 | B2 | 5/2005 | Rutherford et al. | 29/426.4 |
| 6,943,320 | B1 | 9/2005 | Bavett | 219/213 |

FOREIGN PATENT DOCUMENTS

| | | |
|---|---|---|
| JP | 06129095 | 5/1994 |
| JP | 2001123667 | 5/2001 |

OTHER PUBLICATIONS

"Q Foil Performance" http://www.rotabolt.com/html/gfoil_1.html.
"Q Foil Technology" http://www.rotabolt.com/html/qfoil.html.
"Q Foil Product Features" http://www.rotabolt.com/html/qfoil_2.html.
"Thawzall Product Selection" http://www.themachinecompany.com/products.htm.
"Ground Heaters S3000" http://www.groundheaters.com/s3000.htm.
"How It Works" http://www.groundheaters.com/how_it_works.htm.
"GrafTech" http://www.graphtech.com.
"FP Parallel Constant Watt Heating Cable" Thermon Manufacturing Co.
"SCS Concrete Curing Blankets" http://www.scsincorporated.com/Curingblankets.htm.
"Mauritzon Concrete Curing Blankets" http://www.mauritzononline.com/concretecure.html.
"Concrete-Curing Blankets.Com" http://concrete-curing-blankets.com/.
"Janell Concrete Curing Methods" http://www.janell.com/engineering_data.html.
"GrafTech Material Safety Data Sheet" May 17, 2005.
Concrete Curing Technology, Inc. "Instructions for Use of Pad".

* cited by examiner

MODULAR HEATED COVER

CROSS-REFERENCES TO RELATED APPLICATIONS

This application is a Continuation-in-Part application and claims the benefit of U.S. Provisional Patent Application No. 60/654,702 entitled "A MODULAR ACTIVELY HEATED THERMAL COVER" and filed on Feb. 17, 2005 for David Naylor and U.S. Provisional Patent Application No. 60/656,060 entitled "A MODULAR ACTIVELY HEATED THERMAL COVER" and filed on Feb. 23, 2005 for David Naylor, and Provisional Patent Application No. 60/688,146 entitled "LAMINATE HEATING APPARATUS" and filed on Jun. 6, 2005 for David Naylor, and Utility patent application Ser. No. 11/218,156 entitled "MODULAR HEATED COVER" and filed on Sep. 1, 2005 for David Naylor which are incorporated herein by reference.

FIELD OF THE INVENTION

This invention relates to thermal covers and more particularly relates to modular heated covers configured to couple together.

DESCRIPTION OF THE RELATED ART

Ice, snow, and frost create problems in many areas of construction. For example, when concrete is poured the ground must be thawed and free of snow and frost. In agriculture, planters often plant seeds, bulbs, and the like before the last freeze of the year. In such examples, it is necessary to keep the concrete, soil, and other surfaces free of ice, snow, and frost. In addition, curing of concrete requires that the ground, ambient air, and newly poured concrete maintain a temperature between about 50 degrees Fahrenheit and about 90 degrees Fahrenheit. In industrial applications, outdoor pipes and conduits often require heating or insulation to avoid damage caused by freezing. In residential applications, it is beneficial to keep driveways and walkways clear of snow and ice.

Standard methods for removing and preventing ice, snow, and frost include blowing hot air or water on the surfaces to be thawed, running electric heat trace along surfaces, and/or laying tubing or hoses carrying heated glycol or other fluids along a surface. Unfortunately, such methods are often expensive, time consuming, inefficient, and otherwise problematic.

In construction, ice buildup is particularly problematic. For example, ice and snow may limit the ability to pour concrete, lay roofing material, and the like. In these outdoor construction situations, time and money are frequently lost to delays caused by snow and ice. If delay is unacceptable, the cost to work around the situation may be unreasonable. For example, if concrete is to be poured, the ground must be thawed to a reasonable depth to allow the concrete to adhere to the ground and cure properly. Typically, in order to pour concrete in freezing conditions, earth must be removed to a predetermined depth and replaced with gravel. This process is costly in material and labor.

In addition, it is important to properly cure the concrete for strength once it has been poured. Typically the concrete must cure for about seven days at a temperature within the range of 50 degrees Fahrenheit to 90 degrees Fahrenheit, with 70 degrees Fahrenheit as the optimum temperature. If concrete cures in temperatures below 50 degrees Fahrenheit, the strength and durability of the concrete is greatly reduced.

In an outdoor environment where freezing temperatures exist or may exist, it is difficult to maintain adequate curing temperatures.

In roofing and other outdoor construction trades, it may be similarly important to keep work surfaces free of snow, ice, and frost. Additionally, it may be important to maintain specific temperatures for setting, curing, laying, and pouring various construction products including tile, masonry, or the like.

Although the need for a solution to these problems is particularly great in outdoor construction trades, a solution may be similarly beneficial in various residential, industrial, manufacturing, maintenance, and service fields. For example, a residence or place of business with an outdoor canopy, car port, or the like may require such a solution to keep the canopy free of snow and ice to prevent damage from the weight of accumulated precipitation or frost. Conventional solutions for keeping driveways, overhangs, and the like clear of snow, typically require permanent fixtures that are both costly to install and operate, or small portable devices that do not cover sufficient surface area.

While some solutions are available for construction industries to thaw ground, keep ground thawed, and cure concrete, these solutions are large, expensive to operate and own, time consuming to setup and take down, and complicated. Conventional solutions employ heated air, oil, or fluid delivered to a thawing site by hosing. Typically, the hosing is then covered by a cover such as a tarp or enclosure. Laying and arranging the hosing and cover can be time consuming. Furthermore, heating and circulating the fluid requires significant energy in the form of heaters, pumps, and/or generators.

Currently, few conventional solutions exist that use electricity to produce and conduct heat. Traditionally, this was due to limited circuit designs. Traditional solutions were unable to produce sufficient heat over a sufficient surface area to be practical. The traditional solutions that did exist required special electrical circuits with higher voltages and protected by higher rated breakers. These special electrical circuits are often unavailable at a construction site. Thus using conventional standard circuits, conventional solutions are unable to produce sufficient heat over a sufficiently large surface area to be practical. Typically, 143 BTUs are required to melt a pound of ice. Conventional electrically powered solutions are incapable of providing 143 BTUs over a sufficiently large enough area for practical use in the construction industry. Consequently, the construction industry has turned to bulky, expensive, time consuming heated fluid solutions.

What is needed is a modular heated cover that operates using electricity from standard job site power supplies, is cost effective, portable, light weight, durable, reusable, and modular to provide heated coverage for variable size surfaces efficiently and cost effectively. For example, the modular heated cover may comprise a pliable material that can be rolled or folded and transported easily. Furthermore, the modular heated cover would be configured such that two or more modular heated covers can easily be joined to accommodate various surface sizes. Beneficially, such a device would provide directed radiant heat, modularity, weather isolation, temperature insulation, and solar heat absorption. The modular heated cover would maintain a suitable temperature for exposed concrete to cure properly and quickly and efficiently remove ice, snow, and frost from surfaces, as well as penetrate soil and other material to thaw the material to a suitable depth for concrete pours and other construction projects.

SUMMARY OF THE INVENTION

The present invention has been developed in response to the present state of the art, and in particular, in response to the problems and needs in the art that have not yet been fully solved by currently available ground covers. Accordingly, the present invention has been developed to provide a modular heated cover and associated system that overcomes many or all of the above-discussed shortcomings in the art.

A modular heated cover is presented. As used herein the terms "modular heated cover," "heated blanket," "heated concrete curing blanket," and the like are used to refer to different embodiments of the present invention which is defined by the enclosed claims.

The heated blanket may include a first pliable outer layer and a second pliable outer layer. The outer layers may be joined together by a seam substantially circumscribing the first and second pliable outer layers. The outer layers are configured for durable protection in an outdoor environment. A planar heat spreading element disposed between the first and the second outer layers distributes heat energy across the surface of the heat spreading element from a pliable multi-layered planar electrical heating element in contact with the planar heat spreading element. The pliable multi-layered planar electrical heating element is configured to produce up to about 9 watts per foot with a total wattage not to exceed about 2400 watts. The heated blanket may also include a thermal insulation layer positioned above the pliable multi-layered planar electrical heating element and between the first and the second outer layers such that heat from the pliable multi-layered planar electrical heating element is trapped by, and is conducted away from, the thermal insulation layer.

The multi-layered planar electrical heating element may include at least two substantially resistive elements configured to convert electrical energy to heat energy, a first separation layer disposed to one side of the resistive elements, and a second separation layer disposed to the other side of the resistive elements. The second separation layer may be configured to prevent direct contact between the resistive elements and a surface in contact with the pliable multi-layered electrical heating element.

The multi-layered planar electrical heating element in certain embodiments may include a thermal reflection layer configured to reflect heat radiated from the resistive elements back towards the resistive elements. The multi-layered planar electrical heating element may also include a silicon adhesive disposed between the first separation layer and the second separation layer. The silicon adhesive and separation layers may be configured to facilitate conduction of thermal energy from the resistive elements to the planar heat spreading element by way of the silicon adhesive.

The multi-layered electrical heating element may include one or more electrically conductive threads sandwiched between a top substrate and a bottom substrate. The threads comprise a fibrous material spun into a thread configuration having a plurality of embedded graphite particles. The graphite particles conduct electricity and convert electric energy to thermal energy.

Certain embodiments of the heated blanket comprise multi-layered electrical heating elements configured and sized such that between two and four heated blankets can be coupled to each other to produce up to about 2400 watts of power on a single circuit that provides up to about 120 Volts. Certain embodiments of the heated blanket comprise multi-layered electrical heating elements configured and sized such that between four and eight heated blankets can be coupled to each other to produce up to about 4800 watts of power on a single circuit that provides up to about 240 Volts. The 120 Volt circuit and 240 Volt circuit may include a 20 Amp breaker. To change the amount of heat and total watts produced by a heated blanket, the number and electrical configuration of the resistive elements may be changed. In one embodiment, the multi-layered electrical heating element includes between 2 and 12 resistive elements coupled in series or coupled in a combination of parallel and series. The more resistive elements in the multi-layered electrical heating element the higher the heat output. In addition, the multi-layered electrical heating element may be lengthened to further increase the heat output.

The present invention includes a method of making a heated concrete curing blanket. First, a second pliable outer layer is provided. Next, the heat spreading element is positioned on top of the second pliable outer layer. Next, electrical heating tape is bonded to the planar heat spreading element. Next, the planar heat spreading element is covered by a thermal insulation layer. The thermal insulation layer is covered by a first pliable outer layer. Finally, a seam is formed that joins the first pliable outer layer and the second pliable outer layer. The seam may substantially circumscribe the first outer layer and second outer layer.

Embodiments of the present invention may have a variety of shapes and sizes. Examples of sizes include any two dimensional geometric size including square, rectangle, circle, triangle, and the like. The heated blanket is configured to have a surface area of between about 15 square feet and about 506 square feet.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention. These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples of materials, layers, connectors, conductors, insulators, and the like, to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1:
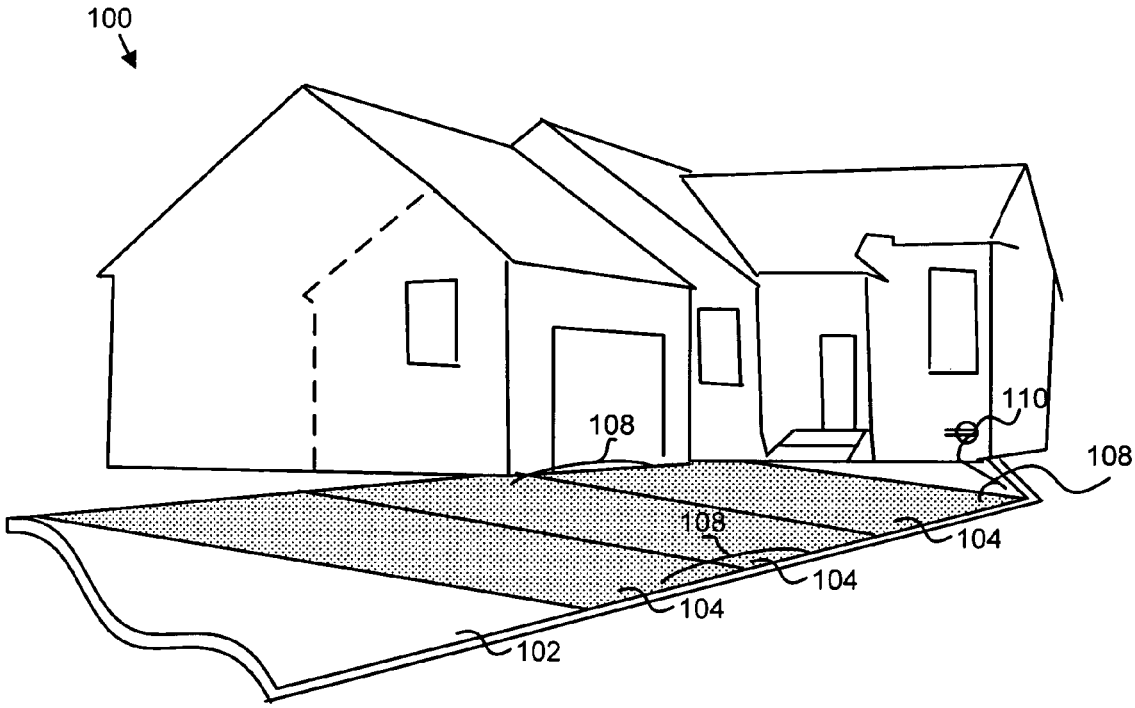
FIG. 1 is a schematic diagram illustrating one embodiment of a system for implementing a modular heated cover.

FIG. 1 illustrates one embodiment of a system 100 for implementing a modular heated cover. In one embodiment, the system 100 includes a surface 102 to be heated, one or more modular heated covers 104, one or more electrical coupling connections 106, a power extension cord 108, and an electrical power source 110.

In various embodiments, the surface to be heated 102 may be planar, curved, or of various other geometric forms. Additionally, the surface to be heated 102 may be vertically oriented, horizontally oriented, or oriented at an angle. In one embodiment, the surface to be heated 102 is concrete. For example, the surface 102 may include a planar concrete pad. Alternatively, the surface may be a cylindrical concrete pillar poured in a vertically oriented cylindrical concrete form. In such embodiments, the thermal cover 104 may melt frost, ice, and snow on the concrete and prevent formation of ice, frost and snow on the surface of the concrete and thermal cover 104.

In another alternative embodiment, the surface 102 may be ground soil of various compositions. In certain circumstances, it may be necessary to heat a ground surface 102 to thaw frozen soil and melt frost and snow, or prevent freezing of soil and formation of frost and snow on the surface of the soil and thermal cover 104. It may be necessary to thaw frozen soil to prepare for pouring new concrete. One of ordinary skill in the art of concrete will recognize the depth of thaw required for pouring concrete and the temperatures required for curing concrete. Alternatively, the surface 102 may comprise poured concrete that has been finished and is beginning the curing process.

In one embodiment, one or more modular heated covers 104 are placed on the surface 102 to thaw or prevent freezing of the surface 102. A plurality of thermal covers 104 may be connected by electrical coupling connections 106 to provide heat to a larger area of the surface 102. In one embodiment, the modular heated covers 104 may include a physical connecting means, an electrical connector, one or more insulation layers, and an active electrical heating element. The electrical heating elements of the thermal covers 104 may be connected in a series configuration. Alternatively, the electrical heating elements of the thermal covers 104 may be connected in a parallel configuration. Detailed embodiments of modular heated covers 104 are discussed further with relation to FIG. 2 through FIG. 4.

In certain embodiments, the electrical power source 110 may be a power outlet connected to a 120V or 240 V AC power line. Alternatively, the power source 110 may be an electric generator. In certain embodiments, the 120V power line may supply a range of current between about 15A and about 50A of electrical current to the thermal cover 104. Alternative embodiments of the power source 110 may include a 240V AC power line. The 240V power line may supply a range of current between about 30A and about 70A of current to the thermal cover 104. Various other embodiments may include supply of three phase power, Direct Current (DC) power, 110 V or 220 V power, or other power supply configurations based on available power, geographic location, and the like.

In one embodiment, a power extension cord 108 may be used to create an electrical connection between a modular heated cover 104, and an electrical power source 110. In one embodiment, the extended electrical coupler 108 is a standard extension cord. Alternatively, the extended electrical coupler 108 may include a heavy duty conductor such as 4 gauge copper and the required electrical connector configuration to connect to high power outlets. Power extension cords 108 may be used to connect the power source 110 to the thermal covers 104, or to connect one thermal cover 104 to another thermal cover 104. In such embodiments, the power extension cords 108 are configured to conduct sufficient electrical current to power the electrical heating element of the modular heated covers 104. One of ordinary skill in the art of power engineering will understand the conductor gauge requirements based on the electric current required to power the thermal cover 104.

Figure 2:
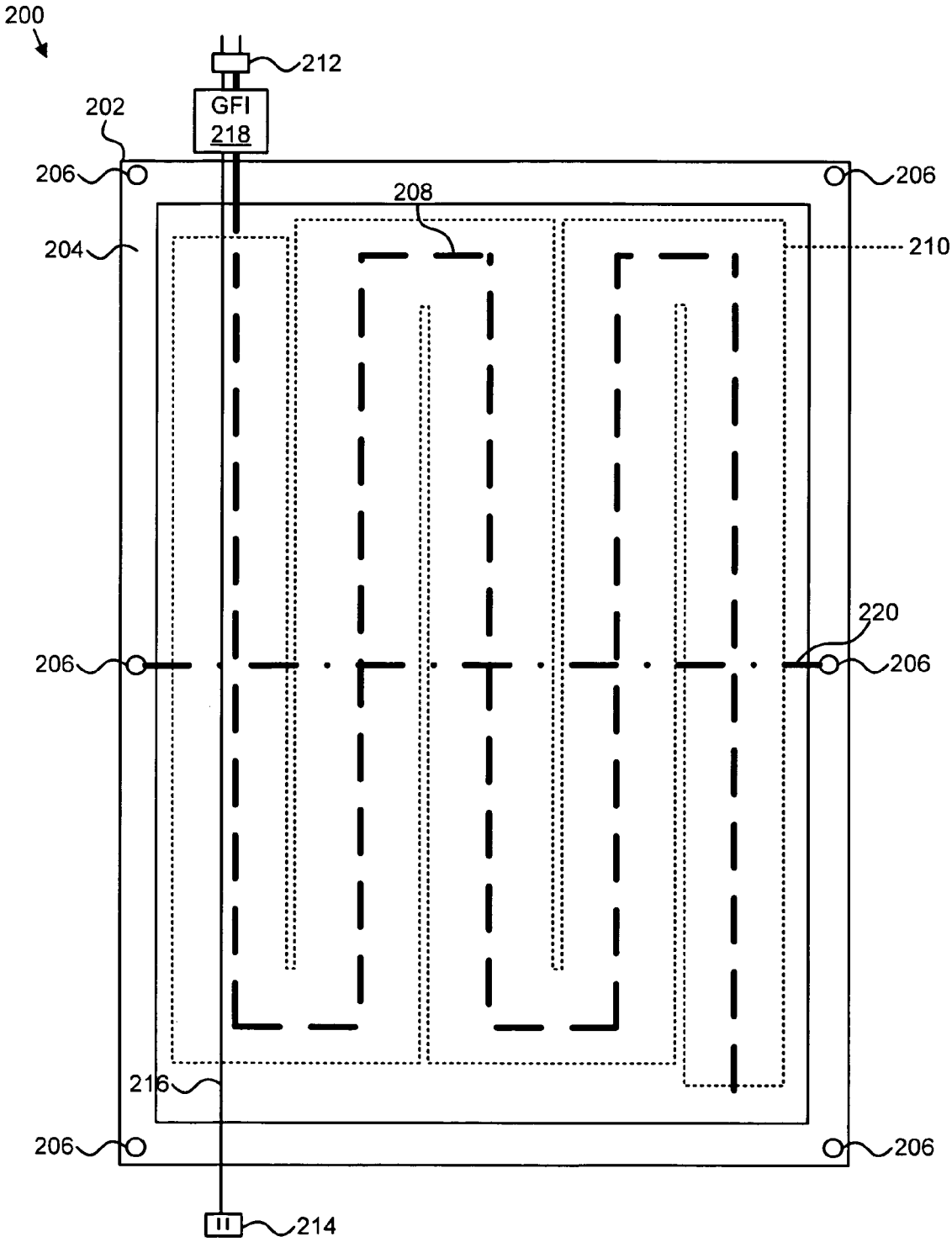
FIG. 2 is a schematic diagram illustrating one embodiment of a modular heated cover.

FIG. 2 illustrates one embodiment of a modular heated cover 200. In one embodiment, the cover 200 includes a multilayered cover 202. The multilayered cover 202 may include a flap 204. Additionally, the cover 200 may be coupled to an electrical heating element. In one embodiment, the electrical heating element comprises a resistive element 208 and a heat spreading element 210. The cover 200 may additionally include one or more fasteners 206, one or more electric power connections 212, one or more electric power couplings 214, and an electrical connection 216 between the connections 212 and the couplings 214. In certain embodiments the thermal cover 200 may additionally include a GFI device 218 and one or more creases 220.

The multilayered cover 202 may comprise a textile fabric. The textile fabric may include natural or synthetic products. For example, the multilayered cover 202 may comprise burlap, canvas, or cotton. In another example, the multilayered cover 202 may comprise nylon, vinyl, or other synthetic textile material. For example, the multilayered cover 202 may comprise a thin sheet of plastic, metal foil, polystyrene, or the like. Further embodiments of the multilayered cover 202 are discussed below with regard to FIG. 3.

In one embodiment, the flap 204 may overlap another thermal cover 200. The flap 204 may provide isolation of air trapped beneath the thermal cover 200. Isolation of the air trapped beneath the thermal cover 200 prevents heat loss due to air circulation. Additionally, the flap 204 may include one or more fasteners 206 for hanging, securing, or connecting the thermal cover 200. In one embodiment, the fasteners 206 may be attached to the corners of the cover 200. Additionally, fasteners 206 may be distributed about the perimeter of the cover 200. In one embodiment, the fastener 206 is Velcro™. For example, the flap may include a hook fabric on one side and a loop fabric on the other side. In another alternative embodiment, the fastener 206 may include snaps, zippers, adhesives, and the like.

In one embodiment, the electrical heating element comprises an electro-thermal coupling material or resistive element 208. For example, the resistive element 208 may be a copper conductor. The copper conductor may convert electrical energy to heat energy, and transfer the heat energy to the surrounding environment. Alternatively, the resistive element 208 may comprise another conductor capable of converting electrical energy to heat energy. One skilled in the art of electro-thermal energy conversion will recognize additional material suitable for forming the resistive element 208. Additionally, the resistive element 208 may include one or more layers for electrical insulation, temperature regulation, and ruggedization. In one embodiment, the resistive element 208 may include two conductors connected at one end to create a closed circuit.

Additionally, the electrical heating element may comprise a heat spreading element 210. In general terms, the heat spreading element 210 is a layer of material capable of drawing heat from the resistive element 208 and distributing the heat energy away from the resistive element 208. Specifically, the heat spreading element 210 may comprise a metallic foil, graphite, a composite material, or other substantially planar material. The heat spreading element 210 may comprise a material that is thermally isotropic in one plane. The thermally isotropic material may distribute the heat energy more evenly and more efficiently.

One such material suitable for forming the heat spreading layer 210 is GRAFOIL® available from Graftech Inc. located in Lakewood, Ohio. The heat spreading element 210 may comprise a planar thermal conductor. In certain embodiments, the heat spreading layer 210 is formed in strips along the length of the resistive element 208, as illustrated in FIG. 2. In alternative embodiments, the heat spreading element 210 may comprise a contiguous layer. In certain embodiments, the heat spreading layer 210 in the form of a contiguous layer may cover substantially the full surface area covered by the thermal cover 200 for even heat distribution across the full area of the thermal cover 200.

In certain embodiments, the resistive element 208 is in direct contact with the heat spreading element 210 to ensure efficient thermo-coupling. Alternatively, the heat spreading element 210 and the resistive element 208 are integrally formed. For example, the heat spreading element 210 may be formed or molded around the resistive element 208. Alternatively, the resistive element 208 and the heat spreading element 210 may be adhesively coupled.

In one embodiment, the thermal cover 200 includes means, such as electrical coupling connections 106, for electric power transfer from one thermal cover 200 to another in a modular chain. For example, the thermal cover 200 may include an electric connection 212 and an electric coupling 214. In one embodiment, the electric connection 212 and the electric coupling 214 may include an electric plug 212 and an electric socket 214, and are configured according to standard requirements according to the power level to be transferred. For example, the electric plug 212 and the electric socket 214 may be standard two prong connectors for low power applications. Alternatively, the plug 212 and socket 214 may be a three prong grounded configuration, or a specialized prong configuration for higher power transfer.

In one embodiment, the electrical connection 216 is an insulated wire conductor for transferring power to the next thermal cover 200 in a modular chain. The electrical connection 216 may be connected to the electric plug 212 and the electric socket 214 for a power transfer interface. In one embodiment, the electrical connection 216 is configured to create a parallel chain of active electrical heating elements 208. Alternatively, the electrical connection 216 is configured to create a series configuration of active electrical heating elements. In an alternative embodiment, the resistive element 208 may additionally provide the electrical connection 216 without requiring a separate conductor. In certain embodiments, the electrical connection 216 may be configured to provide electrical power to a plurality of electrical power couplings 214 positioned at distributed points on the thermal cover 200 for convenience in coupling multiple modular thermal covers 200. For example, a second thermal cover 200 may be connected to a first thermal cover 200 by corresponding power couplings 214 to facilitate positioning of the thermal covers end to end, side by side, in a staggered configuration, or the like.

Additionally, the thermal cover 200 may include a Ground Fault Interrupter (GFI) or Ground Fault Circuit Interrupter (GFCI) safety device 218. The GFI device 218 may be coupled to the power connection 212. In certain embodiments, the GFI device 218 may be connected to the resistive element 208 and interrupt the circuit created by the resistive element 208, as needed. The GFI device 218 may protect the thermal cover 200 from damage from spikes in electric current delivered by the power source 110 or other dangerous electrical conditions.

In certain additional embodiments, the thermal cover 200 may include one or more creases 220 to facilitate folding the thermal cover 200. The creases 220 may be oriented across the width or length of the thermal cover 200. In one embodiment, the crease 220 is formed by heat welding a first outer layer to a second outer layer. Preferably, the thermal cover 200 comprises pliable material, however the creases 220 may facilitate folding of the thermal cover 200.

In one embodiment, the thermal cover 200 may be twelve feet by twenty-five feet in dimension. In another embodiment, the thermal cover 200 may be six feet by twenty-five feet. In yet another embodiment, the thermal cover 200 is eleven feet by twenty three feet. Alternatively, the thermal cover 200 may be between two to four feet in width by fifty feet in length to provide thermal protection for the top of concrete forms. Additional alternative dimensional embodiments may exist. Consequently, the thermal cover 200 in different size configurations covers between about one square foot up to about five-hundred and six square feet.

Beneficially, up to a five-hundred and six square foot area is covered and kept at optimal concrete curing temperatures or at optimal heating temperatures for thawing frozen or cold soil. Advantageously, the high square footage can be heated using a single thermal cover 200 connected to a single 120 volt circuit or connected to a single 240 volt circuit. Preferably, the 120 volt circuit and 240 volt circuit are protected by up to about a 20 Amp breaker. In addition, with the first thermal cover 200 connected to the power source 110 a second thermal cover 200 can be safely connected to the first thermal cover 200 without tripping the breaker.

Consequently, the present invention allows up to two or more thermal covers 200 to be modularly connected such that about five hundred and six square feet are covered and heated using the present invention. Advantageously, the five hundred and six square feet are heated using either a single 120 Volt circuit or a single 240 Volt circuit each protected by up to a 20 Amp breaker. Tests of certain embodiments of the present invention have been conducted in which two thermal covers 200 were modularly connected to cover about five hundred and six square feet. Those of skill in the art will recognize that more than two thermal covers may be connected on a single 120 Volt circuit or a single 240 Volt circuit with up to a 20 Amp breaker if the watts used per foot is lowered.

Figure 3:
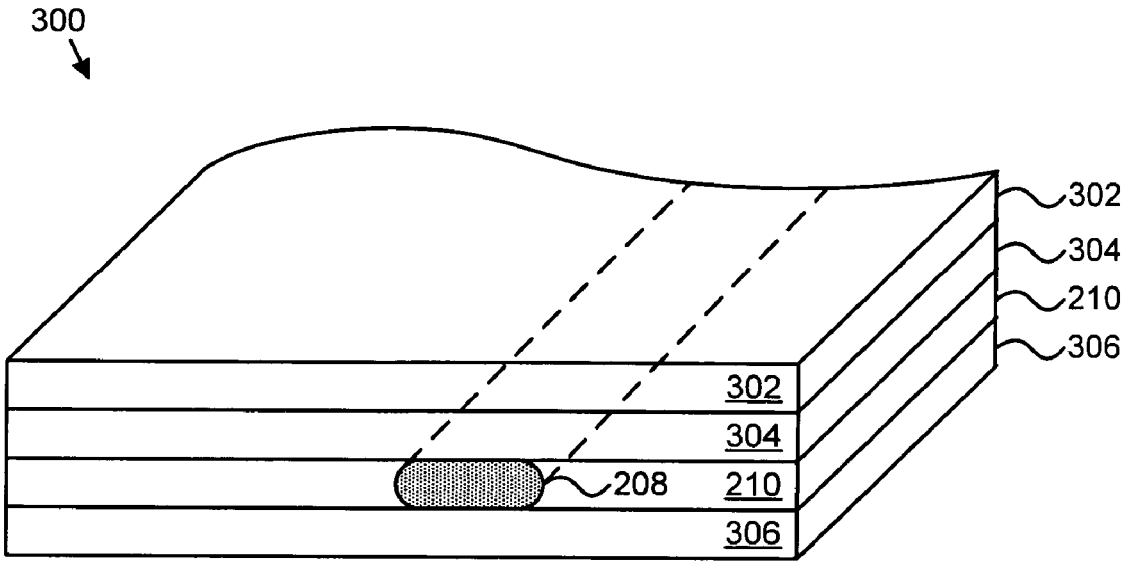
FIG. 3 is a schematic cross-sectional diagram illustrating one embodiment of a modular heated cover.

FIG. 3 illustrates one embodiment of a multilayer modular heated cover 300. In one embodiment, the thermal cover 300 includes a first outer layer 302, an insulation layer 304, a resistive element 208, a heat spreading element 210, and a second outer layer 306. In one embodiment, the layers of the thermal cover 300 comprise fire retardant material. In one embodiment, the materials used in the various layers of the thermal cover 300 are selected for high durability in an outdoor environment, light weight, fire retardant, sun and water rot resistant characteristics, water resistant characteristics, pliability, and the like. For example, the thermal cover 300 may comprise material suitable for one man to roll, carry, and spread the thermal cover 300 in a wet, rugged, and cold environment. Therefore, the material is preferably lightweight, durable, water resistant, fire retardant, and the like. Additionally, the material may be selected based on cost effectiveness.

In one embodiment, the first outer layer 302 may be positioned on the top of the thermal cover 300 and the second outer layer 306 may be positioned on the bottom of the thermal cover 300. In certain embodiments, the first outer layer 302 and the second outer layer 306 may comprise the same or similar material. Alternatively, the first outer layer 302 and the second outer layer 306 may comprise different materials, each material possessing properties beneficial to the specified surface environment.

For example, the first outer layer 302 may comprise a material that is resistant to sun rot such as such as polyester, plastic, and the like. The bottom layer 306 may comprise material that is resistant to mildew, mold, and water rot such as nylon. The outer layers 302, 306 may comprise a highly durable material. The material may be textile or sheet, and natural or synthetic. For example, the outer layers 302, 306 may comprise a nylon textile. Additionally, the outer layers 302, 306 may be coated with a water resistant or waterproofing coating. For example, a polyurethane coating may be applied to the outer surfaces of the outer layers 302, 310. Additionally, the top and bottom outer layers 302, 306 may be colored, or coated with a colored coating such as paint. In one embodiment, the color may be selected based on heat reflective or heat absorptive properties. For example, the top layer 302 may be colored black for maximum solar heat absorption. The bottom layer 302 may be colored grey for a high heat transfer rate or to maximize heat retention beneath the cover.

In one embodiment, the insulation layer 304 provides thermal insulation to retain heat generated by the resistive element 208 beneath the thermal cover 300. In one embodiment, the insulation layer 304 is a sheet of polystyrene. Alternatively, the insulation layer may include cotton batting, Gore-Tex®, fiberglass, or other insulation material. In certain embodiments, the insulation layer 304 may allow a portion of the heat generated by the resistive element 208 to escape the top of the thermal cover 300 to prevent ice and snow accumulation on top of the thermal cover 300. For example, the insulation layer 304 may include a plurality of vents to transfer heat to the top layer 302. In certain embodiments, the thermal insulation layer 304 may be integrated with either the first outer layer 302 or the second outer layer 306. For example, the first outer layer 302 may comprise an insulation fill or batting disposed between two films of nylon.

In one embodiment, the heat spreading element 210 is placed in direct contact with the resistive element 208. The heat spreading element 210 may conduct heat away from the resistive element 208 and spread the heat for a more even distribution of heat. The heat spreading element 210 may comprise any heat conductive material. For example, the heat spreading element 210 may comprise metal foil, wire mesh, and the like. In one embodiment, the resistive element 208 may be wrapped in metal foil. The resistive element 208 may be made from metal such as copper or other heat conductive material such as graphite. Alternatively, the conductive layer may comprise a heat conducting liquid such as water, oil, grease or the like.

Figure 4:
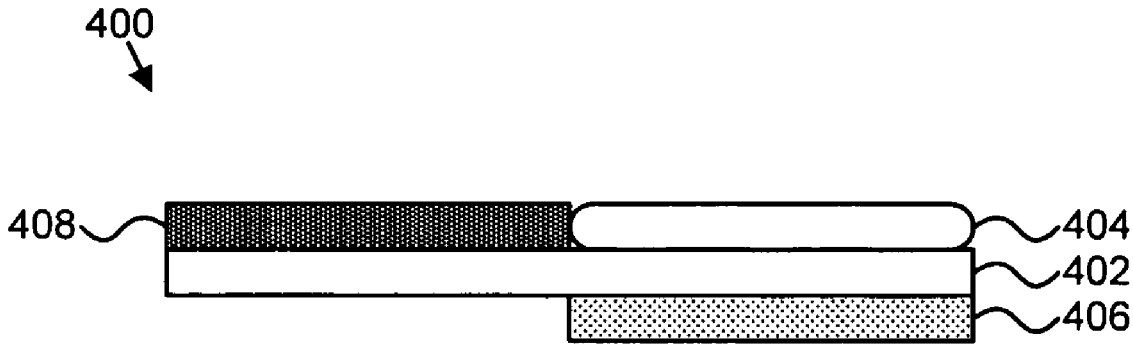
FIG. 4 is a schematic cross-sectional diagram illustrating one embodiment of an air isolation flap.

FIG. 4 illustrates a cross-sectional diagram of one embodiment of an air isolation flap 400. In one embodiment, the air isolation flap 400 includes a portion of a covering sheet 402, a weight 404, a bottom connecting means 406, and a top connecting means 408. In one embodiment, the air isolation flap 400 may extend six inches from the edges of the thermal covering 300. In one embodiment, the air isolation flap 400 may additionally include heavy duty riveted, or tubular edges (not shown) for durability and added air isolation. The covering sheet 402 may comprise a joined portion of the first outer cover 302 and second outer cover 306 that extends around the perimeter of the cover 200 and does not include any intervening layers such as a heat spreading layer 210 or an insulation layer 304.

In one embodiment, the weight 404 is lead, sand, or other weighted material integrated into the air isolation flap 400. Alternatively, the weight may be rock, dirt, or other heavy material placed on the air isolation flap 400 by a user of the thermal cover 200.

In one embodiment, the bottom connecting means 406 and the top connecting means 408 may substantially provide air and water isolation. In one embodiment, the top and bottom connecting means 408, 406 may include weather stripping, adhesive fabric, Velcro, or the like.

Figure 5:
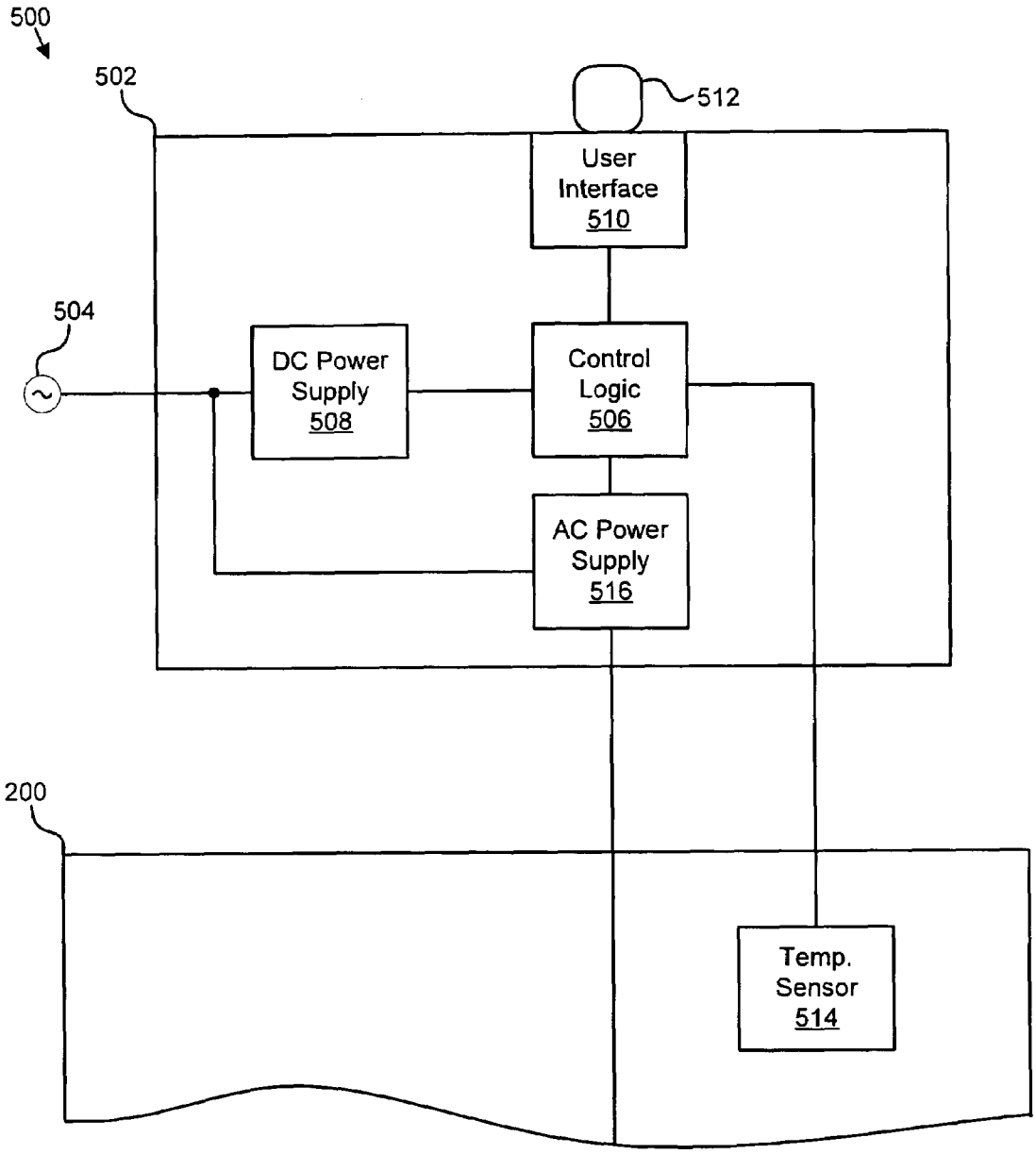
FIG. 5 is a schematic block diagram illustrating one embodiment of a temperature control module.

FIG. 5 illustrates one embodiment of a modular temperature control unit 500. In one embodiment, the temperature control unit may include a housing 502, control logic 506, a DC power supply 508 connected to an AC power source 504, an AC power supply for the thermal cover 200, a user interface 510 with an adjustable user control 512, and a temperature sensor 514.

In one embodiment, the control logic 506 may include a network of amplifiers, transistors, resistors, capacitors, inductors, or the like configured to automatically adjust the power output of the AC power supply 516, thereby controlling the heat energy output of the resistive element 208. In another embodiment, the control logic 206 may include an integrated circuit (IC) chip package specifically for feedback control of temperature. In various embodiments, the control logic 506 may require a 3V–25V DC power supply 508 for operation of the control logic components.

In one embodiment, the user interface 510 comprises an adjustable potentiometer. Additionally, the user interface 510 may comprise an adjustable user control 512 to allow a user to manually adjust the desired power output. In certain embodiments, the user control may include a dial or knob. Additionally, the user control 512 may be labeled to provide the user with power level or temperature level information.

In one embodiment, the temperature sensor 514 is integrated in the thermal cover 200 to provide variable feedback signals determined by the temperature of the thermal cover 200. For example, in one embodiment, the control logic 506 may include calibration logic to calibrate the signal level from the temperature sensor 514 with a usable feedback voltage.

Figure 6:
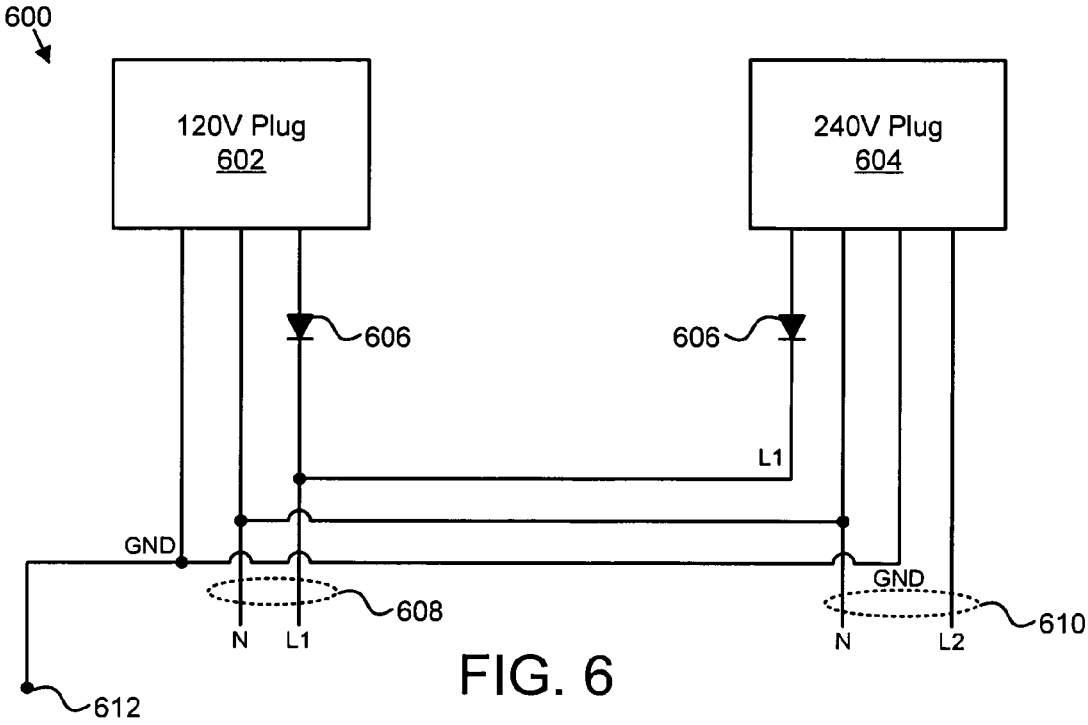
FIG. 6 is a schematic block diagram illustrating one embodiment of an apparatus for providing versatile power connectivity and thermal output.

FIG. 6 illustrates one embodiment of an apparatus 600 for providing versatile power connectivity and thermal output. In one embodiment, the apparatus 600 includes a first electrical plug 602 configured for 120V power, a second electrical plug 604 configured for 240V power, a directional power diode 606, a first active electrical heating element 608, and a second active electrical heating element 610.

In one embodiment, the first electrical heating element 608 is powered when the 120V plug 602 is connected, but the second electrical heating element 610 is isolated by the directional power diode 606. In an additional embodiment, the first electrical heating element 608, and the second electrical heating element 610 are powered simultaneously. In this embodiment, the first electrical heating element 608 and the second electrical heating element 610 are coupled by the directional power diode 606.

In one embodiment, the directional power diode 606 is specified to operate at 240V and up to 70A. The directional power diode 606 allows electric current to flow from the 240V line to the first electrical heating element 608, but stops electric current flow in the reverse direction. In another embodiment, the directional power diode 606 may be replaced by a power transistor configured to switch on when current flows from the 240V line and switch off when current flows from the 120V line.

In one embodiment, the safety ground lines from the 120V connector 602 and the 240V connector 604 are connected to thermal cover 200 at connection point 612. In one embodiment, the safety ground 612 is connected to the heat spreading element 210. Alternatively, the safety ground 612 is connected to the outer layers 302, 310. In another alternative embodiment, the safety ground 612 may be connected to each layer of the thermal cover 200.

Beneficially, the apparatus 600 provides high versatility for power connections, provides variable heat intensity levels, and the like. For example, the first active electrical heating element 608 and the second active electrical heating element 610 may be configured within the thermal cover 200 at a spacing of four inches. In one embodiment, the first active electrical heating element 608 and the second active electrical heating element 610 connect to a hot power line and a neutral power line. The electrical heating elements may be positioned within the thermal cover 200 in a serpentine configuration, an interlocking finger configuration, a coil configuration, or the like. When the 120V plug 602 is connected, only the first active electrical heating element 608 is powered. When the 240V plug 604 is connected, both the first active electrical heating element 608 and the second active electrical heating element 610 are powered. Therefore, the resulting effective spacing of the electrical heating elements is only four inches.

The powered lines of both the 120V plug 602 and the 240V plug 604 may be connected to a directional power diode to isolate the power provided from the other plug. Alternatively, a power transistor, mechanical switch, or the like may be used in the place of the directional power diode to provide power isolation to the plugs. In another embodiment, the both the 120V plug 602, and the 240V plug 604 may include waterproof caps (not shown). In one embodiment, the caps (not shown) may include a power terminating device for safety.

Figure 7:
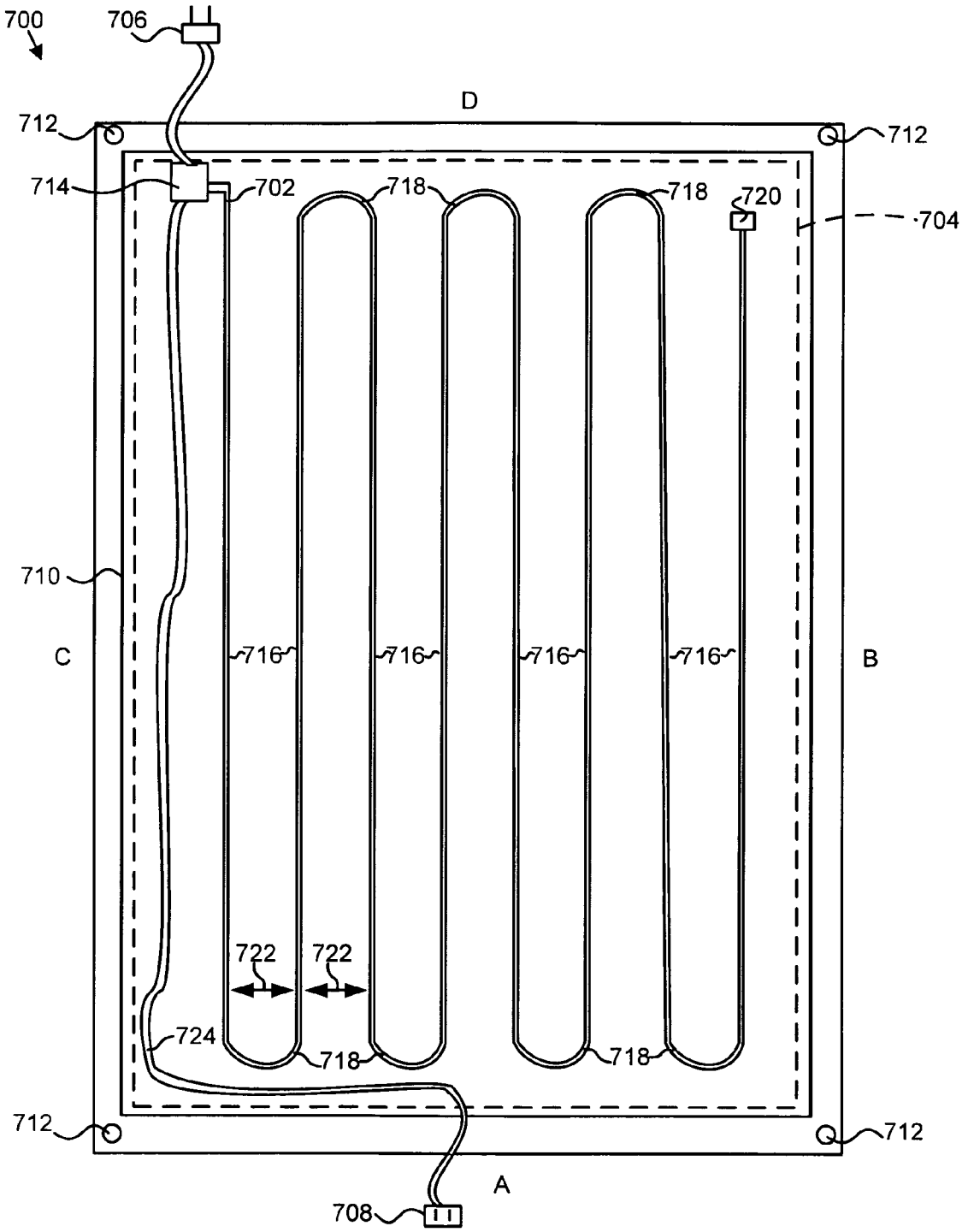
FIG. 7 is a schematic block diagram illustrating one embodiment of a modular heated cover.

FIG. 7 illustrates one embodiment of a modular heated cover 700. In one embodiment, the cover 700 comprises multiple layers. The multi-layered cover 700 includes a first pliable outer layer described in more detail below, a pliable multi-layered electrical heating element 702, a planar heat spreading element 704, and at least one electric power coupling 706, 708. Optionally, the cover 700 may also include a seam 710, and fasteners 712.

The pliable multi-layered electrical heating element 702 converts electrical energy to heat energy due to the resistance in the heating element 702. In one embodiment, the multi-layered heating element 702 is a single continuous component secured to the heat spreading element 704. The multi-layered heating element 702 is electrically coupled to the at least one electric power coupling 706, 708 by a connector 714.

The multi-layered heating element 702 is secured to the heat spreading element 704 in a zig-zag pattern comprising a series of runs 716 and turns 718. In one embodiment, the runs 716 extend along the length of the cover 700 and the turns 718 extend along the width of the cover 700. Those of skill in the art recognize various configurations for how the multi-layered heating element 702 is laid out on the heat spreading element 704. Typically, the closer the runs 716 are to each other, the more heat the multi-layered heating element 702 conducts to the heat spreading element 704.

The number of runs 716, number of turns 718, and the length of the multi-layered heating element 702 are configured to provide optimal heat with the available electric current. The multi-layered heating element 702 and planar heat spreading element are configured to distribute the heat over the surface area of the first outer layer. To provide even heat distribution and maintain air below the first outer layer at a desired temperature between about 50 and about 90 degrees, the number of runs 716, number of turns 718, and the length of the multi-layered heating element 702 are specifically designed depending on the dimensions of the cover 700. The cover 700 may range in size between about 125 square feet and about 230 square feet.

The multi-layered heating element 702 includes at least two resistive elements, discussed in more detail below. In certain embodiments, the multi-layered heating element 702 extends between about seventy-two feet and about two-hundred and, sixty nine feet. The multi-layered heating element 702 may include a connector 720 that electrically couples the at least two resistive elements.

In one embodiment, a cover 700 includes a first outer layer with a surface of about 125 square feet having about 72 feet of the multi-layered heating element 702. The multi-layered heating element 702 may be positioned about five to six inches in toward the center from the edges of the first outer layer. For a cover 700 twenty-five feet by five feet, the multi-layered heating element 702 may extend to form about three runs 716 spaced (indicated by arrow 722) about twenty inches on center across the width of the cover 700.

In another embodiment, a cover 700 comprising a first outer layer with a surface of about 253 square feet may include about 133 feet of the multi-layered heating element 702. The multi-layered heating element 702 may be positioned about five to six inches in from the edges of the first outer layer. For a cover 700 twenty-three feet by ten feet, the multi-layered heating element 702 may extend to form about six runs 716 spaced 722 about twenty inches on center across the width of the cover 700. In this embodiment, the ten foot width may be divided by a crease similar to the crease 220 described in relation to FIG. 2.

In another embodiment, a cover 700 comprising a first outer layer with a surface of about 125 square feet may include about 144 feet of the multi-layered heating element 702. The multi-layered heating element 702 may be positioned about five to six inches within the edges of the first outer layer. For a cover 700 twenty-five feet by five feet, the multi-layered heating element 702 may extend to form about four runs 716 spaced 722 about ten inches on center across the width of the cover 700. A smaller spacing 722 of runs 716 produces more heat than runs 716 spaced twenty inches on center. The greater heat may be used for more sensitive projects in which the heat below the cover 700 needs to be greater and remain at a higher temperature.

In another embodiment, a cover 700 comprising a first outer layer with a surface of about 253 square feet may include about 269 feet of the multi-layered heating element 702. The multi-layered heating element 702 may be positioned about five to six inches in from the edges of the first outer layer. For a cover 700 twenty-three feet by ten feet, the multi-layered heating element 702 may extend to form about six runs 716 spaced 722 about ten inches on center across the width of the cover 700. A smaller spacing 722 of runs 716 produces more heat than runs 716 spaced 722 twenty inches on center. The greater heat may be used for more sensitive projects in which the heat below the cover 700 needs to be greater and remain at a higher temperature. In this embodiment, the ten foot width may be divided by a crease similar to the crease 220 described in relation to FIG. 2. The crease may extend lengthwise along the cover 700.

The planar heat spreading element 704 evenly distributes heat from the multi-layered heating element 702 across the surface of the first outer layer. In one embodiment, the planar heat spreading element 704 is configured to cover substantially the whole surface area within the seam 710. The planar heat spreading element 704 may comprise a material similar in thickness and composition to the material described above for the heat spreading layer 210 (See FIG. 2).

In one embodiment, the planar heat spreading element 704 is one or more layers of graphite deposited between a pair of structural substrates. The structural substrates provide structural integrity for the graphite within the heat spreading element 704. The planar heat spreading element 704 may have a thickness between about three thousandths and about twenty thousands of an inch thick. One such material suitable for forming the planar heat spreading element 704 is GRAFOIL® available from Graftech Inc. located in Lakewood, Ohio.

The at least one electric power coupling 706, 708 removably couples the cover 700 to a power supply. In certain embodiments, the at least one electric power coupling 706, 708 enables the cover 700 to be coupled to a plurality of covers 700 and/or other electronic devices. The cover 700 may include a male electric power coupling 706 and a female electric power coupling 708. In certain embodiments, both electric power couplings 706, 708 are about six feet in length.

A first electric power coupling such as the male electric power coupling 706 may supply electricity from a power source such as a 120 Volt circuit or a 240 Volt circuit each protected by a 20 Amp breaker. The male electric power coupling 706 delivers the electricity to the multi-layered electrical heating element 702 by way of the connector 714. The connector 714 splices the male electric power coupling 706 and the heating element 702.

In one embodiment, the cover 700 includes a second outer layer joined to the first outer layer by the seam 710. The second outer layer is not illustrated in FIG. 7 to avoid obscuring details of the cover 700. The seam circumscribes the first and second outer layers. The seam 710 may comprise a heat weld, a sewn seam or the like. In one embodiment, the seam 710 forms a water-tight seam between the first outer layer and second outer layer with at least the planar heat spreading element 704 and electrical heating element 702 between them.

The connector 714 may splice the male electric power coupling 706 to the female electric power coupling 708 by way of a transfer line 724. The transfer line 724 may comprise a portion of the female electric power coupling 708 between the outer layers. Alternatively, the transfer line 724 comprises twisted pair wiring of a sufficient length to join the connector 714 and the female electric power coupling 708.

In certain embodiments, the female electric power coupling 708 is sized and positioned to facilitate coupling a first cover 700 to a second cover. In FIG. 7, the female electric power coupling 708 extends from an opening in the second outer layer at about midway along the width of the cover 700. In this manner, the male electric power coupling 706 can be coupled to a power supply such as a 120 Volt outlet or a 240 Volt outlet. The female electric power coupling 708 can then be coupled to a second male electric power coupling of a second cover. The second cover may be of the same size or a different size.

In certain embodiments, the cover 700 ranges in size between about 15 square feet and about 253 square feet. Advantageously, the female electric power coupling 708 permits multiple covers 700 to be selectively joined together to increase the effective surface area heated by the covers 700. The multiple covers 700 may be combined so long as watts produced by the combined covers 700 does not exceed more than about 2400 watts on a single circuit that provides up to about 120 Volts and is protected by up to about a 20 Amp circuit. In another embodiment, the multiple covers 700 may be combined so long as watts produced by the combined covers 700 does not exceed more than about 4800 watts on a single circuit that provides up to about 240 Volts and is protected by up to about a 20 Amp circuit.

Typically, the amount of watts produced depends on the type of multi-layered electrical heating element 702 and the length of the multi-layered electrical heating element 702. In certain embodiments, the multi-layered electrical heating element 702 generates about nine watts per foot on a single 120 Volt circuit. The total wattage produced by a single multi-layered electrical heating element 702 or a plurality of multi-layered electrical heating elements 702 joined in series does not exceed about 2400 watts. In certain embodiments, the multi-layered electrical heating element 702 generates about nine watts per foot on a 240 Volt circuit. The total wattage produced by a single multi-layered electrical heating element 702 or a plurality of multi-layered electrical heating elements 702 joined in series does not exceed about 4800 watts.

Advantageously, between two and four covers 700 can be coupled together on a single 120 Volt circuit protected by up to about a 20 Amp breaker. Therefore, for covers 700 where the multi-layered electrical heating element 702 is about 72 feet, about four covers 700 of the same configuration can be coupled together and produce up to about 2400 watts. For covers 700 where the multi-layered electrical heating element 702 is about 133 feet, about 2 covers 700 of the same configuration can be coupled together and produce up to about 2400 watts. For covers 700 where the multi-layered electrical heating element 702 is about 144 feet, about 2 covers 700 of the same configuration can be coupled together and produce up to about 2400 watts. For a cover 700 where the multi-layered electrical heating element 702 is about 269 feet, no additional covers 700 may be coupled to the cover 700 because the cover 700 already generates about 2400 watts. Therefore, a cover with 269 feet of multi-layered electrical heating element 702 may not include a female electric power coupling 708. Given spacing of runs 716 of ten or twenty inches on center, the surface area of the cover 700 ranges between about fifteen square feet and about 253 square feet.

In another embodiment, between two and eight covers 700 can be coupled together on a single 240 Volt circuit protected by up to about a 20 Amp breaker. Therefore, for covers 700 where the multi-layered electrical heating element 702 is about 72 feet, about eight covers 700 of the same configuration can be coupled together and produce up to about 4800 watts. For covers 700 where the multi-layered electrical heating element 702 is about 133 feet, about four covers 700 of the same configuration can be coupled together and produce up to about 4800 watts. For covers 700 where the multi-layered electrical heating element 702 is about 144 feet in length, about four covers 700 of the same configuration can be coupled together and produce up to about 4800 watts. For a cover 700 where the multi-layered electrical heating element 702 is about 269 feet, about two covers 700 of the same configuration may be coupled together and produce up to about 4800 watts. A cover with 269 feet of multi-layered electrical heating element 702 may not include a female electric power coupling 708. Given spacing of runs 716 of ten or twenty inches on center, the surface area of the cover 700 ranges between about 15 square feet and about 506 square feet.

For a cover 700 that is capable of being coupled to at least one other cover 700, the second cover 700 can be positioned in up to three optimal positions relative to the first cover 700. Such positioning increases the effective square feet heated by either a single 120 Volt circuit or a single 240 Volt circuit. As illustrated in FIG. 7, the second cover may be positioned adjacent to the first cover 700 at position A. Alternatively, the second cover may be positioned along side of the first cover 700 at positions B or C. And in certain embodiments, given a sufficiently long male electric power coupling 706 and/or female electric power coupling 708, the second cover may be placed adjacent to the first cover in position D. The modular nature of the covers 700 permits coverage of different sizes and shapes of ground and/or concrete.

Figure 8A:
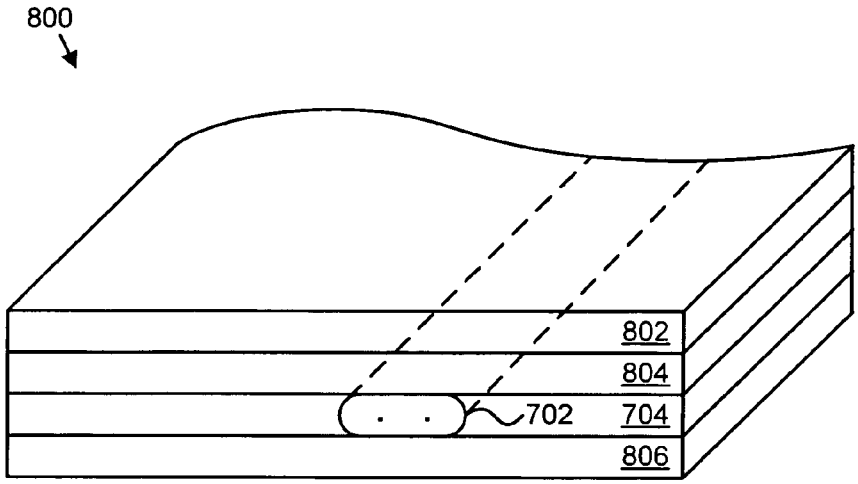
FIG. 8A is a schematic cross-sectional diagram illustrating one embodiment of a modular heated cover.

FIG. 8A illustrates one embodiment of a heated blanket 800. In one embodiment, the heated blanket 800 includes a first outer layer 802, a thermal insulation layer 804, a multi-layered electrical heating element 702, a heat spreading element 704, and a second outer layer 806. The first outer layer 802 may be substantially similar to the top outer layer 302 and the second outer layer 806 may be substantially similar to the bottom outer layer 306 described above in relation to FIG. 3. The first outer layer 802 and the second outer layer 806 may comprise a vinyl material that includes embedded threads.

In certain embodiments, the insulation layer 804 provides thermal insulation to retain heat generated by the multi-layered electrical heating element 702 beneath the insulation layer 804. Typically, the insulation layer 804 is positioned above the multi-layered electrical heating element 702 such that heat is directed downward to the soil, concrete, or other material that is to be heated or maintained at a constant temperature. Typically, there is no insulation layer 804 between the multi-layered electrical heating element 702 and the second outer layer 806. In this manner, the heat is conducted and/or radiated unimpeded towards a surface or object to be heated.

The insulation layer 804 permits the heat spreading element 704 to conduct away heat trapped by the insulation layer 804. The insulation layer 804 provides minimal thermal conductivity (High R-value) with a minimum thickness and minimal weight. The insulation layer 804 may be positioned between the first outer layer 802 and the heat spreading layer 704. The multi-layered electrical heating element 702 may be positioned between the insulation layer 804 and the heat spreading layer 704.

In one embodiment, the insulation layer 804 is substantially similar to the insulation layer 304 described above in relation to FIG. 3. In another embodiment, the insulation layer 304 comprises an aerogel in laminate form. For example, suitable aerogels that may be used for the insulation layer 804 are known by the trademarks of Spaceloft™ AR5101, Spaceloft™ AR5103 available from Aspen Aerogels, Inc. of Northborough, Mass. USA.

Other aerogel materials that may be suitable for the insulation layer 804 may include Spaceloft™ AR3101, Spaceloft™ AR3102, Spaceloft™ AR3103, Pyrogel® AR5222, Pyrogel® AR5223, Pyrogel® AR5401, Pyrogel® AR5402 or the like. Alternatively, the insulation layer may include cotton batting, Gore-Tex®, fiberglass, or other insulation material. In certain embodiments, the insulation layer 804 may include a plurality of vents to transfer heat to the top layer 802. In certain embodiments, the thermal insulation layer 804 may be integrated with either the first outer layer 802 or the second outer layer 806. For example, the first outer layer 802 may comprise an insulation fill or batting disposed between two films of nylon.

In one embodiment, the heat spreading element 704 is placed in direct contact with the multi-layered electrical heating element 702. The heat spreading element 704 may conduct heat away from the multi-layered electrical heating element 702, drawing out the heat and spreading the heat for a more even distribution of heat. The heat spreading element 704 may comprise any heat conductive material substantially similar to the heat spreading element 210 described above in relation to FIG. 3.

Figure 8B:
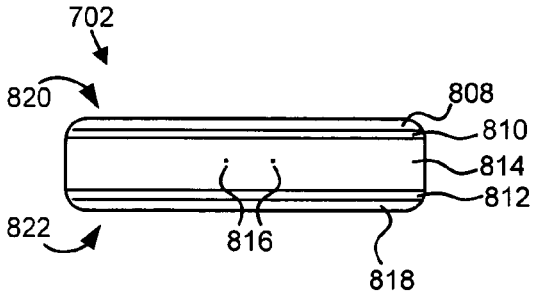
FIG. 8B is a schematic cross-section diagram illustrating one embodiment of a pliable multi-layered electrical heating element.

FIG. 8B illustrates a cross-section view of the multi-layered electrical heating element 702. Typically, the multi-layered electrical heating element 702 is between about 0.2 inches and 0.3 inches thick and between about ⅙ of an inch and ½ of an inch wide. Advantageously, the small dimensions of the multi-layered electrical heating element 702 reduces the overall weight of the cover 700. In certain embodiments, the multi-layered electrical heating element 702 is referred herein to as electrical heating tape 702. The configuration of the electrical heating tape 702 is specifically designed to suit the heating requirements for different embodiments of the cover 700.

The multi-layered electrical heating element 702 includes a thermal reflection layer 808, a first separation layer 810, a second separation layer 812, with an adhesive 814 and at least two resistive elements 816 disposed between the first separation layer 810 and second separation layer 812. Optionally, in certain embodiments, the multi-layered electrical heating element 702 also includes a backing 818. The multi-layered electrical heating element 702 includes a top 820 and a bottom 822.

The thermal reflection layer 808 reflects heat radiated from the resistive elements 816 back towards the resistive elements 816. The thermal reflection layer 808 is preferably at the top 820 of the multi-layered electrical heating element 702 such that the heat generated by the multi-layered electrical heating element 702 is directed towards the bottom 822. The thermal reflection layer 808 is preferably made from a highly reflective material such as aluminum, gold, or other pure metal or metal alloy foil. Alternatively, the thermal reflection layer 808 may comprise a fibrous man-made or natural material that includes a reflective coating on the side facing the bottom 822. Typically, the thermal reflection layer 808 is very thin.

The first separation layer 810 and second separation layer 812 separate the resistive elements 816 from directly contacting the reflection layer 808 or a surface contacting the electrical heating tape 702. The first separation layer 810 and second separation layer 812 may be formed from the same materials and have substantially the same configuration, or may be formed of different materials. The separation layers 810, 812 electrically insulate the resistive elements 816 from contacting electrically conductive material (such as the thermal reflection layer 808 or a conductive surface) that may cause an electrical short. The separation layers 810, 812 also maintain the positioning of the resistive elements 816 relative to each other and within the electrical heating tape 702.

Typically, the resistive elements 816 comprise a conductive wire such as copper, silver, gold, or the like. In certain embodiments, the resistive elements 816 are specifically configured to handle expansion during use and contraction when not in use. For example, the resistive elements 816 may include a squiggle (a slight bend up and down along the length of the resistive element). The squiggle permits the resistive element 816 to expand and extend its length when energized and contract and return to an original shape when the resistive element 816 is not energized. In certain embodiments, the resistive elements 816 may include an enamel coating that serves as one example of an insulator which further insulates against an electrical short.

In certain embodiments, in addition to electrical insulation, the first separation layer 810 and second separation layer 812 facilitate conduction of thermal energy from the resistive elements 816 to the heat spreading element 704. Accordingly, in one embodiment, the first separation layer 810 and second separation layer 812 comprise a porous material that permits the adhesive 814 to impregnate the first separation layer 810 and second separation layer 812. In this manner, the adhesive 814 serves as a thermal conductor carrying heat from the resistive elements 816 through the first separation layer 810 and second separation layer 812. In particular, the adhesive 814 conducts heat from the resistive elements 816 to the heat spreading element 704.

Thermal energy can be transmitted by conduction through a material, by conduction through a gas, and by radiation. The thermal reflection layer 808 reflects radiated heat. Gas conduction through a gas such as air is typically not effective because gas has a low thermal conductivity. The adhesive 814 serves as a material conductor of heat energy in place of the gas or air that ordinarily might surround the resistive elements 816.

In one embodiment, the first separation layer 810 and second separation layer 812 may comprise a woven material such as woven fiberglass strands. Of course other man-made and natural electrically insulating materials may be woven to form the first separation layer 810 and second separation layer 812. The holes in the weave permit the adhesive 814 to penetrate the layers 810, 812.

The adhesive 814 serves to hold layers 808, 810, 812, and 818 together. In addition, the adhesive facilitates conduction of thermal energy from the resistive elements 816 to the heat spreading element 704. The adhesive 814 has an effective operating temperature range of between about −100 degrees Celsius and about 250 degrees Celsius and a high thermal conductivity. The adhesive 814 in certain embodiments is a silicon adhesive readily available to those of skill in the art. Alternatively, the adhesive 814 is an acrylic adhesive that is also readily available. The thickness of the adhesive 814 may range between about 0.25 to about 0.028.

In certain embodiments, the adhesive 814 serves to adhere the multi-layered electrical heating element 702 to the heat spreading element 704. In certain embodiments, a secondary bonding agent such as various tapes including masking tape, duct tape, electrical tape or glues may be used to enhance the adhesion of the multi-layered electrical heating element 702 to the heat spreading element 704. In one embodiment, the backing 818 is readily removable such that the second separation layer 812 can be directly connected to the heat spreading element 704 by way of the adhesive 814. In this manner, the adhesive 814 provides a direct thermal path for heat from the resistive elements 816 to the heat spreading element 704.

Advantageously, the type and configuration of the multi-layered electrical heating element 702 depending on the heating requirements for the cover 700, 800. For example, the number of resistive elements 816 can vary between two and multiples of two up to about 12 resistive elements 816. Of course, as the number of resistive elements 816 increases the width of the multi-layered electrical heating element 702 may be increased to maintain adequate inter-resistive element spacing. As the number of resistive elements 816 changes and the length of the multi-layered electrical heating element 702 changes other characteristics of the multi-layered electrical heating element 702 may also be changed.

Advantageously, this flexibility permits the multi-layered electrical heating element 702 to be used in various different cover 700 configurations, including those discussed above in relation to FIG. 7.

Typically, the multi-layered electrical heating element 702 generates about nine watts of power per foot. Depending on the length of the multi-layered electrical heating element 702 and the number of resistive elements 816, the multi-layered electrical heating element 702 draws between about 5.4 amperes and about 20 amperes with a resistance of between about 24 ohms and about 5.9 ohms. In addition, the multi-layered electrical heating element 702 uses between about 0.65 kilowatts per hour and about 4.8 kilowatts per hour. Beneficially, these ranges are within those available on a 120 Volt circuit or a 240 Volt circuit protected by a 20 amp breaker as found at most construction sites. Of course, other sizes of breakers may be used with the present invention as well.

Figure 8C:
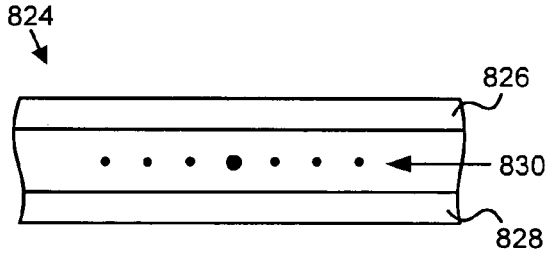
FIG. 8C is a schematic cross-section diagram illustrating one embodiment of a pliable multi-layered electrical heating element.

FIG. 8C illustrates an alternative multi-layered electrical heating element 824 has a thickness of between about 1/16 of an inch and about 1/4 of an inch. The heating element 814 may be between about 1/2 of an inch and two inches in width. The multi-layered electrical heating element 824 may include a top substrate 826, a bottom substrate 828, and one or more electrically conductive threads 830. The top substrate 826 and bottom substrate 828 keep the threads 830 in position relative to each other. The top substrate 826 and bottom substrate 828 may be joined by an adhesive, heat welding, or other well known fastening means. In one embodiment, the bottom substrate 828 comprises adhesive on both sides to facilitate fastening the multi-layered electrical heating element 824 to the heat spreading element 704.

The threads 830 may comprise graphite embedded fibers made from man-made or nature materials including wool, polyester, and the like. The embedded fibers may be spun into a thread or yarn configuration. The graphite is embedded in the fibers of the yarn or thread material such that the threads 830 conduct electricity and convert electricity to heat. In certain embodiments, the multi-layered electrical heating element 824 comprises a plurality of threads 830 aligned in parallel. The plurality of threads 830 may be electrically coupled in series or parallel. Advantageously, the threads 830 are more pliable than embodiments having resistive elements 816 made of metal wires. Consequently, the threads 830 are expected to have greater durability than metal wire resistive elements 816. In other words, the threads 830 may be able to withstand more folding or rolling of the cover for repeated use.

Figure 8D:
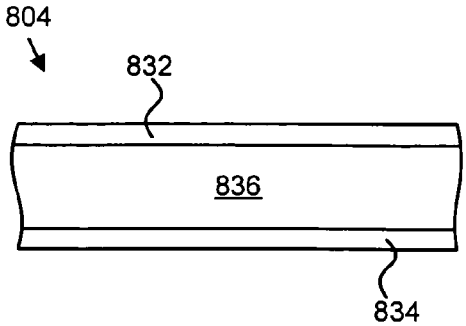
FIG. 8D is a schematic cross-section diagram illustrating one embodiment of a thermal insulation layer.

FIG. 8D illustrates a cross-section view of one embodiment of the thermal insulation layer 804. The insulation layer 804 comprises a top laminate layer 832, a bottom laminate layer 834, and an aerogel layer 836 in between. The aerogel layer 836 comprises aerogel which is a material made from silica (silicon dioxide). Aerogel may be referred to as Spaceloft™, Pryogel™, Nanogel, Airglass, nanoglass™. As mentioned above, Aerogel is available from Aspen Aerogels, Nanopore in Albuquerque, NM, or Airglass in Lund Sweden. Aerogel is typically a fragile material. Aerogel is a porous solid having many nanometer size pores organized into a network. These pores trap air which provides a high insulation value meaning there is very low thermal conductivity.

Advantageously, the laminate layers 832, 834 provide structural integrity for the aerogel layer 836. The laminate layers 832, 834 may comprise pliable layers of plastic, vinyl, rubber, metal foil, or the like sealed to each other or directly to the aerogel. The laminate layers 832, 834 keep the aerogel together and protect the aerogel from damage.

In certain embodiments, the aerogel layer 836 is sandwiched between the laminate layers 832, 834. The aerogel layer 836 may have a thickness between about 3/4 of an inch and about 1/16 of an inch. The thermal conductivity for the aerogel layer 836 may range between about 0.089 BTU-in/hr-ft$^2$ and about 0.108 BTU-in/hr-ft$^2$ at a mean temperature of 100 degrees Fahrenheit. The aerogel layer 836 and laminate layers 832, 834 are pliable such that the insulation layer 804 can be rolled or folded without damaging the aerogel layer 836.

Figure 9A:
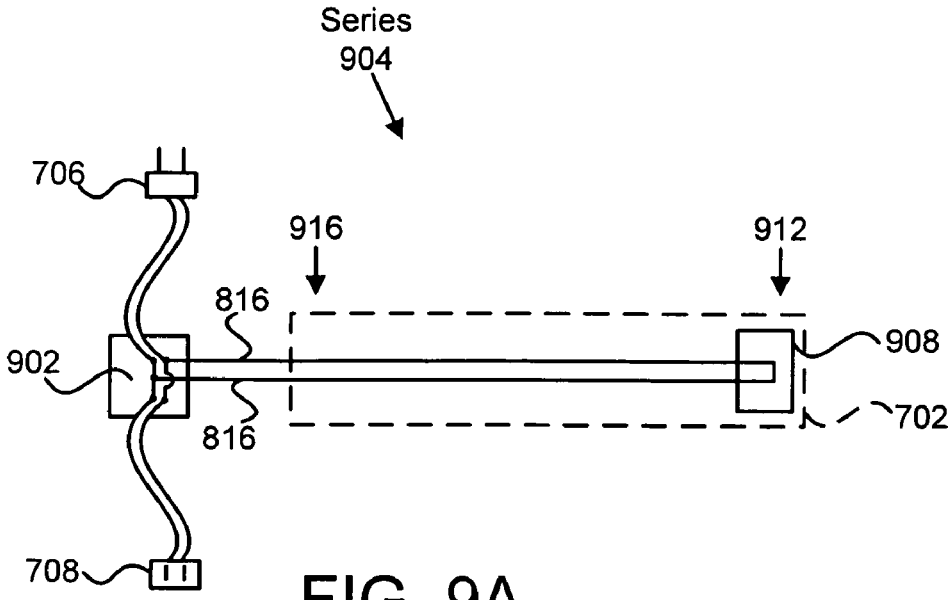
FIG. 9A is an electrical schematic diagram illustrating one embodiment of a pliable multi-layered electrical heating element in a series configuration.
Figure 9B:
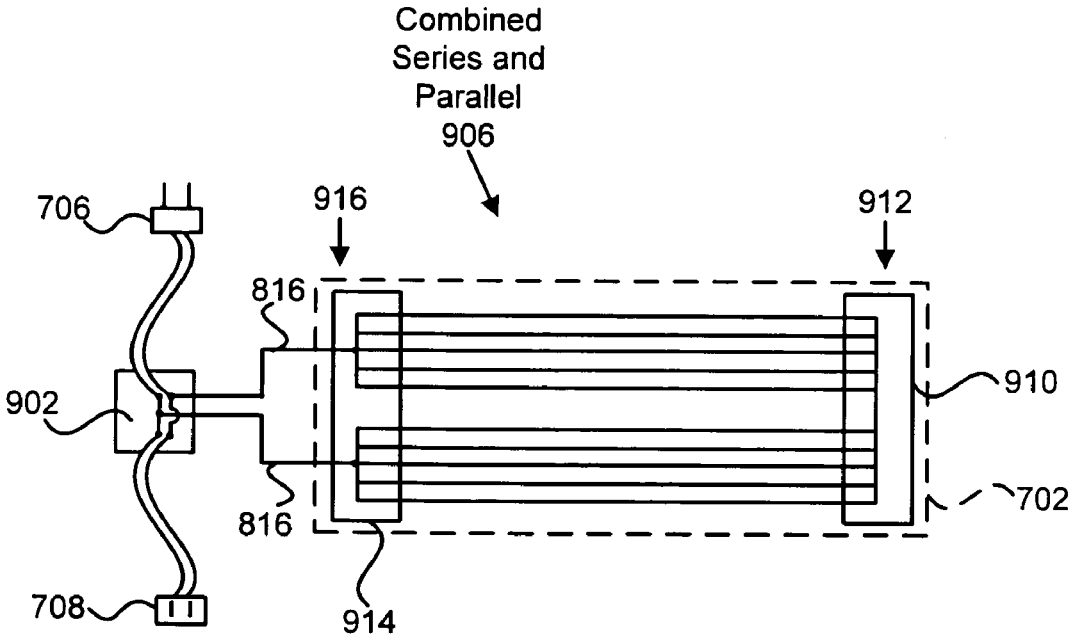
FIG. 9B is a schematic cross-section diagram illustrating one embodiment of a pliable multi-layered electrical heating element in a combined series and parallel configuration.

FIG. 9A illustrates an electronic schematic diagram of one embodiment of a heated blanket. FIG. 9B illustrates an electronic schematic diagram of another embodiment of a heated blanket. Note, the layout of the heat tape 702 is simplified for clarity. For example, the length of couplings 706, 708 is not drawn to scale. FIGS. 9A and 9B illustrate how a male electric power coupling 706 may be wired in series with a female electric power coupling 708 by way of a connector 902. Those of skill in the art recognize that a plurality of connectors 902 may be used in place of a single connector 902. In addition, those of skill in the art recognize that the wires and/or resistive elements 816 may be electrically coupled using various fasteners including soldering, metallic connectors, twist connectors, and the like.

Electrically, the resistive elements 816 within the heat tape 702 may be connected in a series configuration 904 or in a combined series and parallel configuration 906. In a series configuration 904, the heat tape 702 may include at least two resistive elements 816. The resistive elements 816 may be electrically connected at the end opposite the connector 902 by a direct connection or by a connector 908. In embodiments having an odd number of resistive elements, the connector 908 is configured such that the electrical circuit as viewed from the resistive elements 816 exiting connector 902 and returning to connector 902 is in series electrically.

In a combined series and parallel configuration 906, a connector 910 connects two or more resistive elements 816 on a tail end 912 of the heat tape 702 in parallel. Another connector 914 connects the two or more resistive elements 816 on a head end 916 in parallel such that two parallel sets are created. In addition to forming a top parallel set and a bottom parallel set, the connector 910 also joins the two parallel sets in series.

Advantageously, the two or more resistive elements 816 are positioned longitudinally within the heat tape 702 as illustrated. In a series configuration 904, an odd number of resistive elements 816 may be connected in alternating fashion by the connector 908 at the tail end 912 and another connector such as connector 914 at the head end 916.

In FIG. 9B, five resistive elements 816 one side are connected in parallel and these five resistive elements 816 are connected in series to a second parallel set of resistive elements 816. Increasing the number of resistive elements 816 increases the amount of heat produced by the heat tape 702. The amount of heat produced is selected according to the size of the heated blanket 700 and the desired level of heat performance required. Certain heated blankets 700 may be used in moderate weather conditions that experience moderate temperature drops. Other heated blankets 700 may be designed for use in harsh weather conditions in which extreme temperature drops exist.

Figure 10:
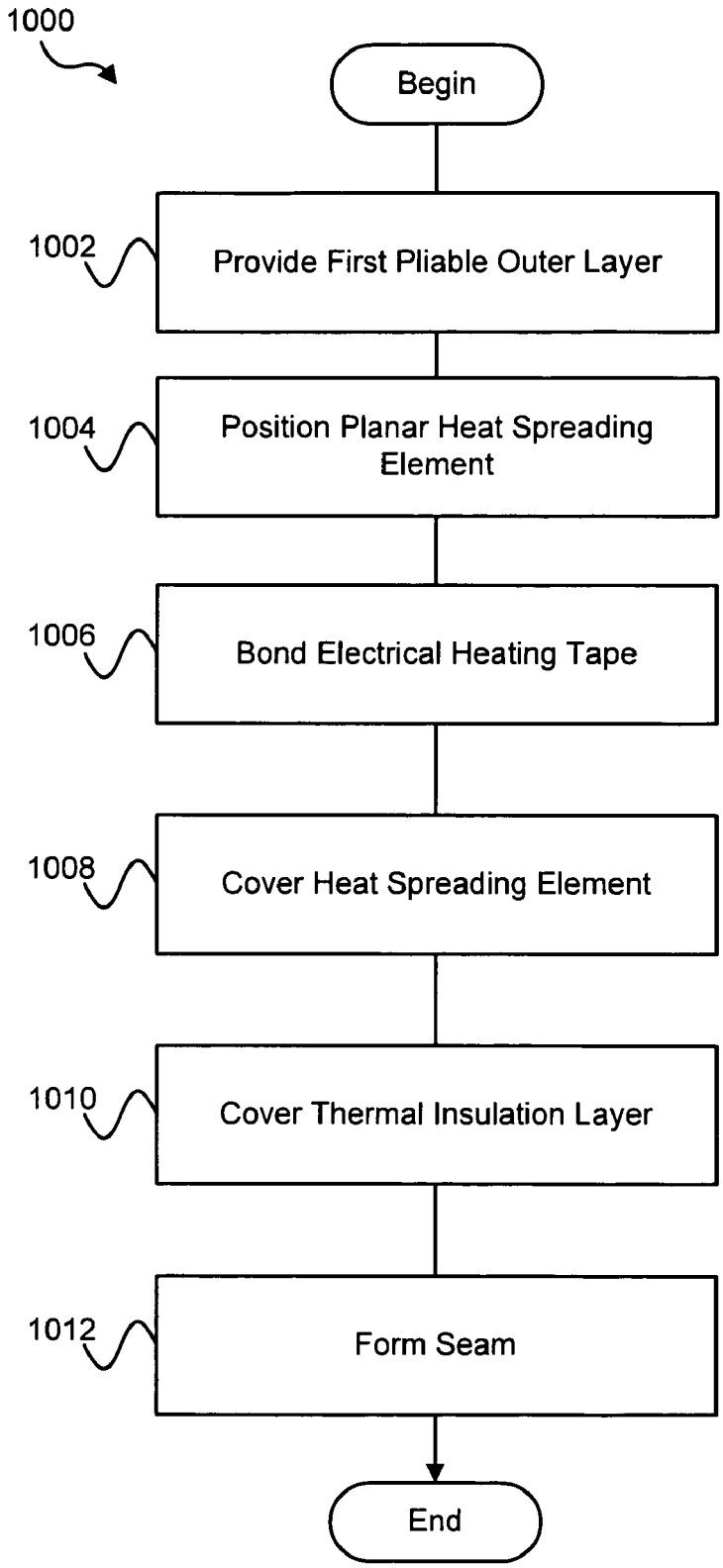
FIG. 10 illustrates a flow chart diagram of a method for making a heated concrete curing blanket according to one embodiment of the present invention.

FIG. 10 illustrates a method 1000 for making a heated concrete blanket 700. The method 1000 incorporates the components, materials, and apparatuses discussed above in relation to FIGS. 1–9. The method 1000 begins by providing 1002 a second pliable outer layer 806. Typically, the second pliable outer layer 806 is laid out flat on a table or floor. Next, a planar heat spreading element 704 is positioned 1004 on top of the second pliable outer layer 806. Typically, the planar heat spreading element 704 is of the same geometric shape as the second pliable outer layer 806. Of course the second pliable outer layer 806 may comprise various geometric shapes including square, rectangle, triangle, circle, and the like. The planar heat spreading element 704 may be smaller by about five to twelve inches in width and by about five to twelve inches in height than the second pliable outer layer 806. In one embodiment, the planar heat spreading element 704 is centered over the second pliable outer layer 806.

Next, electrical heating tape 702 is bonded 1006 to the planar heat spreading element 704. In one embodiment, a manufacturer supplies electrical heating tape 702 having the configuration illustrated and described in relation to FIG. 8B. In addition, the heating tape manufacturer may supply the heating tape 702 with the resistive elements 816 electrically coupled to the male electric power coupling 706, transfer line 724, and female electric power coupling 708. In addition, the heating tape 702 supplied by a manufacturer may comprise suitable connectors 714, 720 for a particular model of heated concrete curing blanket 700. In other words, the connectors 714, 720 may operably connect the resistive elements 816 in the heating tape 702 for one of a series configuration 904 and a combined series and parallel configuration 906. One supplier of heating tape 702 suitable for the present invention may comprise Clayborn Labs Inc., of Truckee, Calif.

In one embodiment, bonding 1006 the electrical heating tape 702 to the planar heat spreading element 704 includes laying out the electrical heating tape 702 on top of the planar heat spreading element 704 in a zig-zag pattern similar to the pattern illustrated in FIG. 7. The zig-zag pattern may comprise runs 716 that extend along the length of the planar heat spreading element 704 with turns 718 that extend along the width of the planar heat spreading element 704. As described above, the runs 716 may be positioned between about ten inches on center and about twenty inches on center. In one embodiment, the zig-zag pattern begins at one corner. Those of skill in the art recognize that the zig-zag pattern can start at any point within the perimeter of the planar heat spreading element 704 so long as the heating tape 702 is evenly distributed across the surface of the planar heat spreading element 704. Typically, the zig-zag pattern begins near the perimeter. In one embodiment, the layout pattern beginning with the connector 714 may begin in the center of the planar heat spreading element 704 and the remainder of the heating tape 702 may be laid out in a spiral pattern. Of course other lay out patterns may be used as well.

In certain embodiments, the electrical heating tape 702 is bonded 1006 to the planar heat spreading element 704 by a bonding agent. In one embodiment, the adhesive 814 in the heating tape 702 serves as the bonding agent. A worker may remove a backing 818 from the heating tape 702 to expose the adhesive impregnated second separation layer 812. Next, the worker may place the exposed second separation layer 812 on the planar heat spreading element 704 according to a pattern such as the zig-zag pattern.

In certain embodiments, a worker may optionally apply a secondary bonding agent such a tape or glue to further secure the heating tape 702. For example, the turns 718 may be secured with a secondary bonding agent such as masking tape, duck tape, duct tape, glue, or other adhesive. In one embodiment, the turn 718 comprises portion of the heating tape folded over the top of itself at a forty-five degree angle to form a ninety degree angle between the run 716 and the turn 718 with the exposed adhesive size of the heating tape facing away from the heat spreading element 704. A second fold of the heating tape 702 at a forty-five degree angle forms a ninety degree angle between the turn 718 and a second run 716. The second run 716 may be substantially parallel to the first run 716. Since, the adhesive 814 is not in contact with the heat spreading element 704, the secondary bonding agent may serve to secure the turn 718 to the heat spreading element 704.

The method 1000 continues with a worker covering 1008 the heat spreading element 704 with a thermal insulation layer 804. The thermal insulation layer 804 typically matches the size and shape of the heat spreading element 704. In one embodiment, the thermal insulation layer 804 is centered over the heat spreading element 704. Next, a worker covers 1010 the thermal insulation layer 804 with a first pliable outer layer 802. The first pliable outer layer 802 typically matches the size and shape of the second pliable outer layer 806. In one embodiment, the first pliable outer layer 802 is centered over the second pliable outer layer 806.

Finally in one embodiment, a seam 710 is formed 1012 between the first pliable outer layer 802 and the second pliable outer layer 806. Typically, the seam 710 substantially circumscribes the first pliable outer layer 802 and the second pliable outer layer 806. The seam 710 may be formed by heat welding, use of an adhesive, or stitching of the first pliable outer layer 802 and the second pliable outer layer 806 together. The seam 710 may include one or more openings to permit the male electric power coupling 706 and/or female electric power coupling 708 to extend from the first pliable outer layer 802. Alternatively, an opening in one or more of the thermal insulation layer 804, first pliable outer layer 802, heat spreading layer 704, and/or second pliable outer layer 806 may permit extension of the male electric power coupling 706 and/or female electric power coupling 708. The opening may be water-proof.

The seam 710 forms a pocket between the first pliable outer layer 802 and the second pliable outer layer 806 that keeps the heat spreading element 704 in place. In certain embodiments, the heat spreading element 704 is sized and shaped to be just smaller than the pocket. Following the method 1000 a light-weight, effective, heated concrete curing blanket 700 can be made.

The heated concrete curing blanket 700 is light enough to be spread and moved by a single person and produces sufficient heat to maintain a temperature for covered concrete between about 50 degrees Fahrenheit and about 90 degrees Fahrenheit while the ambient air temperature is between about 50 degrees Fahrenheit and about zero degrees Fahrenheit. The heated concrete curing blanket 700 can be rolled for storage or transport and operates on a single conventional 120 Volt circuit that may include a 20 Amp circuit breaker. In addition, certain configurations of the heated concrete curing blanket 700 can be coupled to up to three additional concrete curing blankets 700 so long as the total watts produced does not exceed 2400. Other embodiments of the heated concrete curing blanket 700 operated on a single conventional 240 Volt circuit that may include a 20 Amp circuit breaker. In addition, certain configurations of certain embodiments of the heated concrete curing blanket 700 can be coupled to up to three additional concrete curing blankets 700 so long as the total watts produced does not exceed 4800. Consequently, large surface areas can be protected from weather influences while providing sufficient heat to cure concrete. The present invention provides a solution to the problem of accumulated snow, ice, and frost or frozen work surfaces in various construction, residential, industrial, manufacturing, maintenance, agriculture, and service fields.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A heated blanket comprising:

a first pliable outer layer configured for durable protection in an outdoor environment;

a pliable multi-layered electrical heating element positioned on one side of the first outer layer, the multi-layered electrical heating element having at least two resistive elements configured to convert electrical energy to heat energy, wherein the pliable multi-layered electrical heating element is configured to produce about 9 watts per foot with a total wattage not exceeding about 2400 watts;

the pliable multi-layered electrical heating element comprising:

a thermal reflection layer configured to reflect heat radiated from the resistive elements back towards the resistive elements;

a first separation layer disposed between the thermal reflection layer and the resistive elements, the first separation layer configured to prevent direct contact between the thermal reflection layer and the resistive elements;

a second separation layer disposed such that the resistive elements are positioned between the first separation layer and the second separation layer, the second separation layer configured to prevent direct contact between the resistive elements and a surface in contact with the pliable multi-layered electrical heating element; and an adhesive disposed between the first separation layer and the second separation layer, the adhesive and separation layers configured to conduct thermal energy from the resistive elements to the planar heat spreading element by way of the adhesive;

a planar heat spreading element in contact with the multi-layered electrical heating element and configured to draw the heat energy out of the multi-layered electrical heating element and evenly distribute the heat energy over a substantial surface area of the first outer layer; and at least one electric power coupling connected to the pliable multi-layered electrical heating element to supply electrical power.

2. The heated blanket of claim 1, further comprising a second pliable outer layer joined to the first pliable outer layer by a seam substantially circumscribing the first and second pliable outer layers.

3. The heated blanket of claim 1, wherein the planar heat spreading element is sized to substantially cover the surface area of the first outer layer and second outer layer within the seam, the planar heat spreading element comprising a layer of graphite deposited between a pair of structural substrates, the planar heat spreading element having a thickness between about 3 thousandths and about 20 thousandths of an inch thick.

4. The heated blanket of claim 1, wherein the pliable multi-layered electrical heating element comprises one or more electrically conductive threads sandwiched between a top substrate and a bottom substrate, the threads comprising a fibrous material spun into a thread configuration having a plurality of embedded graphite particles, the graphite particles conducting electricity and converting electric energy to thermal energy.

5. The heated blanket of claim 1, wherein the first separation layer and second separation layer comprise a porous material such that the adhesive impregnates the first separation layer and the second separation to conduct heat from the resistive elements to the planar heat spreading element.

6. The heated blanket of claim 1, wherein the first separation layer and second separation layer each comprise a woven fiberglass material and wherein the resistive elements are coated with an insulator.

7. The heated blanket of claim 1, further comprising a thermal insulation layer positioned to one side of the pliable multi-layered electrical heating element opposite the planar heat spreading element such that heat from the pliable multi-layered electrical heating element conducts away from the thermal insulation layer.

8. The heated blanket of claim 7, wherein the thermal insulation layer comprises a silica aerogel material sandwiched between a top laminate layer and a bottom laminate layer, the thermal insulation layer having a thickness between about ¾ of an inch and about 1/16 of an inch and a thermal conductivity of between about 0.089 BTU-in/hr-ft$^2$-° F. and about 0.108 BTU-in/hr-ft$^2$-° F. at a mean temperature of 100 degrees Fahrenheit.

9. The heated blanket of claim 1, wherein the at least one electric power coupling comprises a male electric power coupling and a female electric power coupling, the female electric power coupling sized and positioned in the heated blanket to selectively electrically couple the heated blanket to a second heated blanket by way of a male electric power coupling of the second heated blanket, the second heated blanket configured such that the first heated blanket and second heated blanket combined produce up to about 4,800 watts from a single circuit providing up to about 240 Volts and protected by up to about a 20 Amp breaker.

10. The heated blanket of claim 9, wherein the pliable multi-layered electrical heating element is configured and sized such that between two and four heated blankets are coupleable to produce up to about 4,800 watts on a single circuit that provides up to about 240 Volts and is protected by up to about a 20 Amp breaker.

11. The heated blanket of claim 1, wherein the pliable multi-layered electrical heating element comprises between two and twelve resistive elements, the resistive elements electrically connected in one of a series configuration and a combined parallel and series configuration.

12. The heated blanket of claim 1, wherein the surface area of the heated blanket is between about 15 square feet and about 253 square feet, the heated blanket is electrically coupled to a single circuit that provides up to about 240 Volts and is protected by up to about a 20 Amp breaker.

13. A heated concrete curing blanket comprising:

a first pliable outer layer and a second pliable outer layer joined together by a seam substantially circumscribing the first and second pliable outer layers, wherein the outer layers are configured for durable protection in an outdoor environment;

a planar heat spreading element disposed between the first and the second outer layers and configured for distributing heat energy;

a pliable multi-layered planar electrical heating element in contact with the planar heat spreading element, wherein the pliable multi-layered electrical heating element is configured to produce about 9 watts per foot with a total wattage not exceeding about 2400 watts, the multi-layered planar electrical heating element comprising:

at least two substantially resistive elements configured to convert electrical energy to heat energy;

a first separation layer disposed to one side of the resistive elements;

a second separation layer disposed to the other side of the resistive elements, the second separation layer configured to prevent direct contact between the resistive elements and a surface in contact with the pliable multi-layered electrical heating element;

a silicon adhesive disposed between the first separation layer and the second separation layer, the silicon adhesive and separation layers configured to conduct thermal energy from the resistive elements to the planar heat spreading element by way of the silicon adhesive; and a thermal insulation layer positioned above the pliable multi-layered planar electrical heating element and between the first and the second outer layers such that heat from the pliable multi-layered planar electrical heating element conducts away from the thermal insulation layer.

14. The heated concrete curing blanket of claim 13, wherein the first pliable outer layer and second pliable outer layer have a surface area between about 125 square feet and about 230 square feet and wherein the length of pliable multi-layered planar electrical heating element ranges between about 72 feet and about 269 feet for the heated concrete curing blanket.

15. The heated concrete curing blanket of claim 13, wherein the pliable multi-layered planar electrical heating element is configured to generate about nine watts per foot and, based on the length, the pliable multi-layered planar electrical heating element uses between about 0.65 kilowatts per hour and about 4.8 kilowatts per hour with a resistance of between about 24 ohms and about 5.9 ohms.

* * * * *